US005730207A

United States Patent [19]

Pleschiutschnigg

[11] Patent Number: 5,730,207

[45] Date of Patent: Mar. 24, 1998

[54] METHOD AND CONTINUOUS CASTING INGOT MOLD FOR SHAPING CONTINUOUS CASTINGS

[75] Inventor: Fritz-Peter Pleschiutschnigg, Duisburg, Germany

[73] Assignee: Mannesmann Aktiengesellschaft, Düsseldorf, Germany

[21] Appl. No.: 682,667

[22] PCT Filed: Jan. 20, 1995

[86] PCT No.: PCT/DE95/00092

§ 371 Date: Jul. 29, 1996

§ 102(e) Date: Jul. 29, 1996

[87] PCT Pub. No.: WO95/20443

PCT Pub. Date: Aug. 3, 1995

[30] Foreign Application Priority Data

Jan. 28, 1994 [DE] Germany ..... 44 03 050 .9

[51] Int. Cl.[6] ..... B22D 11/04

[52] U.S. Cl. ..... 164/459; 164/418; 164/491; 164/436

[58] Field of Search ..... 164/418, 459, 164/491, 436

[56] References Cited

U.S. PATENT DOCUMENTS

| | | | |
|---|---|---|---|
| 4,635,702 | 1/1987 | Kolakowski et al. | 164/418 |
| 4,926,930 | 5/1990 | Gay et al. | 164/459 |
| 5,188,167 | 2/1993 | Perry et al. | 164/459 |
| 5,311,922 | 5/1994 | Streubel | 164/418 |

FOREIGN PATENT DOCUMENTS

| | | | |
|---|---|---|---|
| 3643740 | 6/1988 | Germany | 164/418 |
| 2-207945 | 8/1990 | Japan | 164/418 |

*Primary Examiner*—Joseph J. Hai, III
*Assistant Examiner*—I. H. Lin
*Attorney, Agent, or Firm*—Cohen, Pontani, Lieberman, Pavane

[57] ABSTRACT

A continuous casting mold for producing strands in the form of slabs, thin slabs, blooms, and billets resulting in highly reliable casting at casting speeds of up to 6 m/min. The cambered shape of the mold causes the strand to be centered during casting by the mold so that sideways movement of the strand shell toward one of the narrow sides (snaking) is suppressed or moderated. This symmetrical running of the strand shell box during casting in the mold results in a uniform symmetrical formation of the strand shell and its temperature field (isotherms), the withdrawal forces, and the loading of the strand shell in relation to the strand axis in the casting direction, even despite weaving of the strand in the region of the strand guide.

13 Claims, 3 Drawing Sheets

METHOD AND CONTINUOUS CASTING INGOT MOLD FOR SHAPING CONTINUOUS CASTINGS

CROSS-REFERENCE TO RELATED APPLICATION

This application is a 371 of PCT/DE95/00092 filed Jan. 20, 1995.

BACKGROUND OF THE INVENTION

The invention is directed to a continuous casting mold for guiding strands.

DESCRIPTION OF THE PRIOR ART

It is known from DE 39 07 351 A1 to provide continuous casting molds for thin slabs with a funnel-shaped recess in their upper part, that is, in the region of the inlet cross section. This step influences the strand thickness, but has no effect on casting speed.

In the course of development, the following limiting values have taken shape for casting speed with standard strand formats:

- approximately 1.8–2.0 m/min for slabs with a thickness of (for example) 230 mm
- approximately 1.5–1.7 m/min for blooms with a thickness of(for example) 270 mm
- approximately 2.5 m/min for billets with a size of (for example) 100×100 mm.

When these maximum values are exceeded, there is a considerable increase in casting defects in the form of breakout. This is a result of the weaving motion of the strand in the strand guide which occurs at higher speeds. The strand oscillates back and forth in the direction of the narrow sides of the mold. This weaving motion results in nonuniform contact between the strand and the narrow sides of the mold and accordingly leads to asymmetrical heat transfer and to an asymmetrical isotherm profile in the strand shell in the casting direction and vertical thereto.

This disruption of the isotherms leads to stresses and different strand shell thicknesses and accordingly also to distortions of the stand shell which results in an increased breakout rate.

SUMMARY OF THE INVENTION

Therefore, the object of the present invention is to provide a continuous casting mold in which the weaving of the strand, also known in technical literature as "snaking", is prevented.

Pursuant to this object, and others which will become apparent hereafter, one aspect of the present invention resides in a continuous casting mold for guiding strands, particularly steel strands, which mold is comprised of a pair of cooled first side plates and a pair of second side plates arranged between the first side plates either in a stationary manner or adjustable to the strand width. The first side plates have a cambered shape which extends from a vertical position in an upper 80% of the mold height, and particularly the upper 30%, up to the mold outlet opening. The percentage of mold height being determined from the outlet opening, i.e., the mold inlet opening being at 100% of the mold height.

In another embodiment of the invention the camber of the first side plates is configured to take into account the degree of shrinkage of the cast strand.

In still another embodiment of the invention the first side plates are broad side plates and the second side plates are narrow side plates. The camber being configured to extend in a concave manner from a start of a first one of the narrow side plates to a start of a second one of the narrow side plates.

In still yet another embodiment of the invention the concave shape of the camber extends linearly from a center axis of the mold toward the narrow side plates.

Yet another embodiment of the invention provides that the concave shape extends non-linearly from the center axis toward the narrow side plates.

Still another embodiment of the invention provides the concave shape to be formed from the center axis proceeding with a common turning point from circle radii.

The concave shape, in another embodiment of the invention, extends from the center axis along only part of the length of the broad-side plates corresponding to the minimum cast width of a narrowest cast strand. The broad-side plates run parallel in the region of the minimum width and maximum width of cast strands of different width while the narrow side plates are adjustable to different widths of the cast strand in this region.

Yet another embodiment of the invention provides that the side plates run linearly and at an angle in the regions of minimum width and maximum width to reduce the strand thickness outwardly.

In a further embodiment the concave shape of the broad-side plates in the region of the center axis has a maximum height of 5% of the strand thickness at the transitional region between the minimum width and maximum width of the cast strand.

Furthermore, an additional embodiment of the invention provides the concave shape of the broad-side plates to revert to a rectangular form up to the mold outlet.

The drawings serve to illustrate the invention.

DETAILED DESCRIPTION OF THE PREFERRED EMBODIMENTS

The invention consists in that a guiding and centering of the strand is ensured by means of the concave strand guide in the region of the mold and by the accordingly convex strand resulting in an area-specific uniform contact of the strand in the mold so that a high degree of symmetry is ensured in the formation of the strand shell with respect to heat transfer, isotherm profile, and strand shell profile.

This shape of the strand guide and its influence on a uniform formation of the strand shell results in the surprising effect that the casting speed for the strand formats mentioned above can be increased up to 6 m/min.

Figure 1:
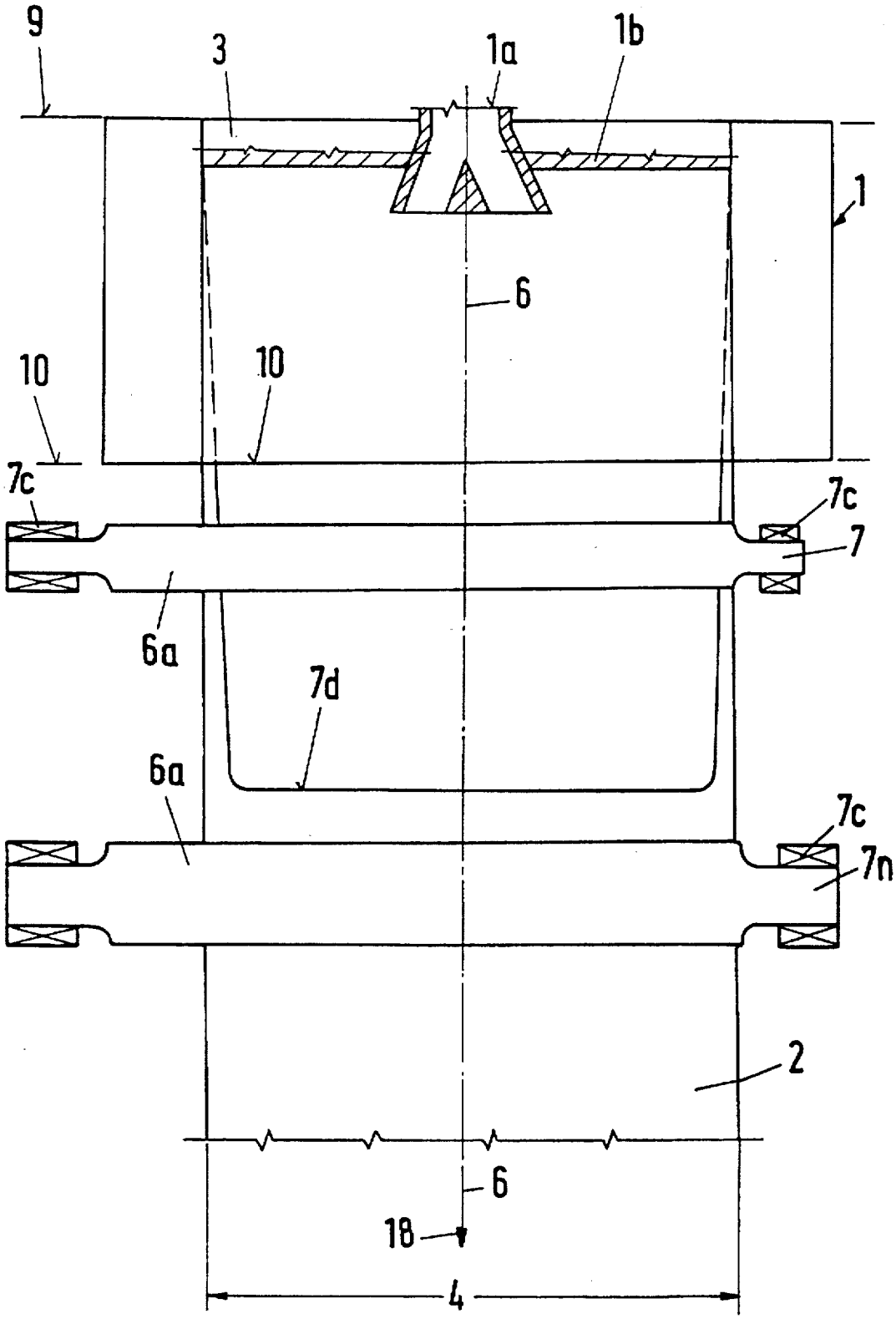
FIG. 1 shows a section through a mold with strand guide in the casting direction pursuant to the present invention.
Figure 2:
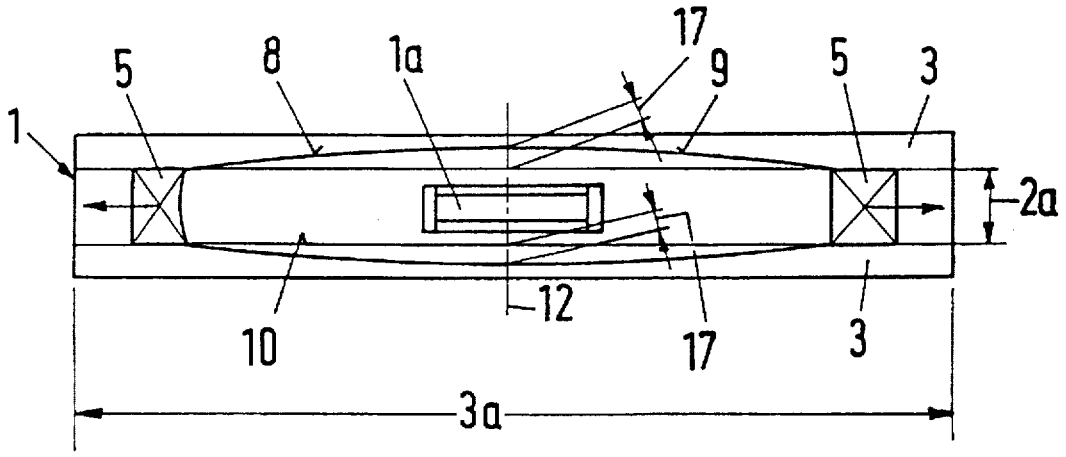
FIG. 2 shows a horizontal section through a mold.
Figure 3:
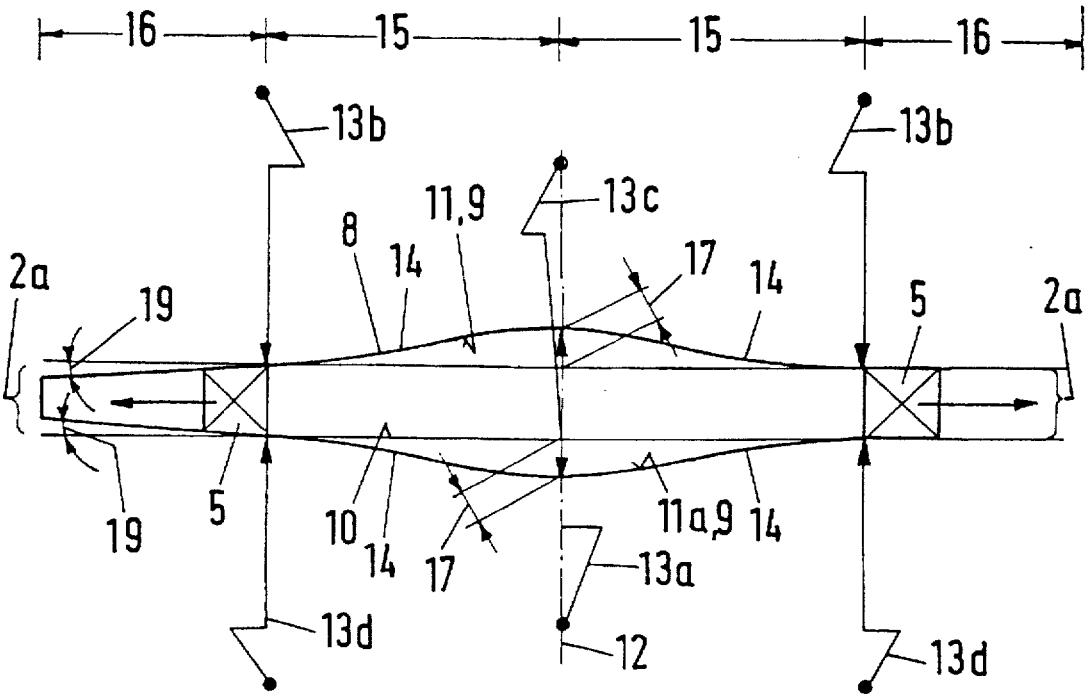
FIG. 3 shows a horizontal section through a mold.

A slabbing installation is described by way of example in FIGS. 1 to 3. The slabbing installation comprises a mold (1) with an adjustable width, whose broad side plates (3) have a concave (i.e. cambered) shape (8) (i.e. cambered) extending symmetrically with reference to the center axis (12) of the mold. This shape is constant from the upper edge (9) of the mold to the outlet (10) of the mold or is uniformly reverted to a rectangular format. The concavity or convex slab has a maximum height (17) of 5% of the slab thickness in relation to the thickness (2*a*) defined by the narrow side plates (5). In other words, the slab has a convex height (17) from the surface of a strand as would be defined by the narrow side plates (5) that is 5% of the strand thickness (2*a*).

In the adjusting region (16) of the narrow side plates (5) of the strand (2) of the mold, the profile extends linearly in a parallel manner or at an inclination angle (19) $\alpha$ not exceeding 2°, as shown in FIG. 3.

The shape of the mold in the concave region may or may not be linear symmetrically with respect to the center axis (12) and the axis (6) of the guidance of the strand. In the present example, an immersion nozzle (1*a*) and casting powder (1*b*) are used for casting. Of course, casting is also possible within the scope of the invention without an immersion nozzle and casting powder.

The constant concavity of the broad sides which is predetermined in the mold is returned to a rectangular form in the strand guide or reverts uniformly along the length of the mold and enters the strand guide with a rectangular form from the outlet of the mold.

Downstream of the mold is provided a series of rollers which include a pair of support rollers 7 which are supported in a bearing 7*c*, and final support rollers 7*n* which are also supported in support bearings. The rollers form a strand guide 6*a*. 7*d* indicates the crater end of the strand. The strand precedes through the mold in the direction 18. The narrow side plates 5 are set to define the strand width 4, as shown in FIG. 1. Meanwhile, FIG. 2 shows the length 3*a* of the broad-side plates 3.

FIG. 3 illustrates the adjustment range of the narrow side plates 5. The narrow side plates 5 can be adjusted to define a minimum width 15 of the strand and a maximum width 16+15. The concave shape 11, 11*a* of the broad-side plate of the mold can also be seen in this figure. 13*a*, 13*c* represent the concave circle radius at the center of the mold while 13*b*, 13*d* indicate the convex circle radius at the outerside of the mold. The concave shape is formed from the center axis 12 preceding with a common turning point 14 from the circle radii 13*a*–*d*.

Figure 4:
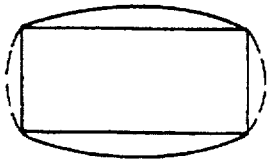
FIG. 4 shows a bloom form.
Figure 5:
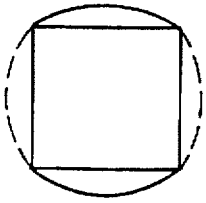
FIG. 5 shows a billet form.

An appropriate shape can also be selected for blooms (FIG. 4) and billets (FIG. 5). For this purpose, two opposite sides or all four sides of the strand can have a convex shape in the mold.

I claim:

1. A continuous casting mold for shaping a strand, comprising:

a pair of cooled first side plate; and second side plates arranged between the first side plates, so as to form a mold chamber, the first side plates each having a cambered surface that extends vertically from a point in an upper 80% of a height of the mold, measured from an outlet opening of the mold, up to the outlet opening, the cambered surfaces of the first side plates being configured to extend in a concave manner from a first one of the second side plates to a second one of the second side plates, the second side plates being narrow-side plates.

2. A continuous casting mold according to claim 1, wherein the second side plates are fixed between the first side plates.

3. A continuous casting mold according to claim 1, wherein the second side plates are adjustably arranged between the first side plates whereby the second side plates can be adjusted to a width of the strand.

4. A continuous casting mold according to claim 1, wherein the cambered surface of the first side plates begins at a point in the upper 30% of the mold height.

5. A continuous casting mold according to claim 1, wherein the camber of the surface of the first side plates is configured to take into account a degree of shrinkage of the cast strand.

6. A continuous casting mold according to claim 1, wherein the concave shape extends linearly from a center axis of the mold toward the narrow-side plates.

7. A continuous casting mold according to claim 1, wherein the concave shape extends non-linearly from a center axis of the mold toward the narrow-side plates.

8. A continuous casting mold according to claim 1, wherein the concave shape is formed from a center axis of the mold preceding with a common turning point from circle radii.

9. A continuous casting mold according to claim 1, wherein the first side plates are broad-side plates, the concave shape extending from a center axis of the mold along only a portion of a length of the broad-side plates corresponding to a minimum cast width of a narrowest cast strand, the broad-side plates being configured to run parallel in regions of a minimum width and a maximum width of cast strands of different width and the narrow side plates being configured to be adjustable to different widths of cast strand in the parallel regions of the broad-side plates.

10. A continuous casting mold according to claim 9, wherein the broad-side plates are configured to run linearly and at an angle in the regions of minimum width and maximum width so as to reduce strand thickness outwardly.

11. A continuous casting mold according to claim 9, wherein the broad-side plates are configured so that the concave shape has a maximum height in a region of the center axis of 5% of strand thickness at a transitional region of the minimum width and a maximum width of the cast strand.

12. A continuous casting mold according to claim 1, wherein the first side plates are broad-side plates, the broad-side plates being configured so that the concave shape reverts to a rectangular shape toward the mold outlet.

13. A method of casting strands with strand thicknesses of 40–400 mm, comprising the steps of:

providing a pair of cooled first side plates and a pair of second side plates arranged between the first side plates so as to define a strand width;

providing each of the first side plates with a cambered surface which extends vertically from a point in an upper 80% of a height of the mold, as measured from an outlet opening of the mold, up to the outlet opening; and providing molten metal to the mold for producing a cast strand having a thickness of 40–400 mm.

* * * * *